US008394451B2

(12) United States Patent
Moebus

(10) Patent No.: US 8,394,451 B2
(45) Date of Patent: Mar. 12, 2013

(54) CONNECTION ELEMENTS COMPRISING A MOLDED ADHESIVE BAR

(75) Inventor: Maik Moebus, Lampertswalde (DE)

(73) Assignee: Kronoplus Technical AG, Niederteufen (CH)

( * ) Notice: Subject to any disclaimer, the term of this patent is extended or adjusted under 35 U.S.C. 154(b) by 998 days.

(21) Appl. No.: 11/814,287

(22) PCT Filed: Dec. 14, 2005

(86) PCT No.: PCT/EP2005/056791

§ 371 (c)(1),
(2), (4) Date: May 13, 2008

(87) PCT Pub. No.: WO2006/076994

PCT Pub. Date: Jul. 27, 2006

(65) Prior Publication Data

US 2008/0271408 A1 Nov. 6, 2008

(30) Foreign Application Priority Data

Jan. 19, 2005 (DE) ..... 20 2005 000 887 U

(51) Int. Cl.
*B05D 5/10* (2006.01)

(52) U.S. Cl. ..... 427/208.6; 427/207.1; 427/208.2; 52/578; 52/579; 52/582.1

(58) Field of Classification Search ..... 427/207.1, 427/208.2, 208.6; 52/578, 582.1
See application file for complete search history.

(56) References Cited

U.S. PATENT DOCUMENTS

| | | | | |
|---|---|---|---|---|
| 6,284,074 | B1 * | 9/2001 | Braund et al. | 156/64 |
| 2003/0004263 | A1 * | 1/2003 | Schmidt et al. | 524/589 |
| 2004/0128934 | A1 | 7/2004 | Hecht | |
| 2006/0003144 | A1 * | 1/2006 | Kaump | 428/131 |

FOREIGN PATENT DOCUMENTS

| | | |
|---|---|---|
| DE | 100 64 587 | 7/2002 |
| DE | 103 37 352 | 9/2004 |
| WO | 2004/079128 | 9/2004 |

* cited by examiner

*Primary Examiner* — Nathan Empie
*Assistant Examiner* — Xiao Zhao
(74) *Attorney, Agent, or Firm* — Renner, Otto, Boisselle & Sklar, LLP

(57) ABSTRACT

The invention relates to connection elements comprising a tongue (3) and a groove (10), and an additional locking element (6) which is connected thereto in a non-positive manner, which consists of a plastic or adhesive material and is especially embodied as a bar.

16 Claims, 3 Drawing Sheets

CONNECTION ELEMENTS COMPRISING A MOLDED ADHESIVE BAR

The invention relates to connection elements of panels for floors, walls or ceilings, which allow for a positive locking. Connection elements in the sense of the present application are for example known from the publications WO 01/48332 A1, WO 01/88306 A1, WO 03/087497 and EP 1 024 234 B1. Further, a method for a production of connection elements is disclosed. The connection elements are also referred to as coupling elements.

The connection elements for panels known from the publications WO 01/48332 and EP 1 024 234 B1 are produced essentially from one piece of HDF and are manufactured from the HDF or MDF base material of the panels. The panels can be connected by means of displacing the same in one plane. As it was proven during the opposition proceedings against the patent EP 1 024 234 B1 by opponent O1, such panels have in praxis, once they are installed, the disadvantage, that visible gaps are formed relatively fast and in particular at the narrow edge of such panels, i.e. at the two shorter edges of a rectangular panel.

From publication EP 1 215 352 B1 it is known, to produce a flank of a groove from a different material at the narrow edge of a panel, to provide an improved connection between two panels also on the narrow edges of the same. Unfortunately, this solution requires a relatively high amount of material, since HDF material already provided by a board has first to be milled-off and than replaced by a different material.

From publication WO 2004/079 128 it is known, only to produce the connection elements from a different material. A further processing of this different material by means of for example milling should be disposed off. A disadvantage of the solution known from this document is that panels can be loosened from each other with relatively low effort.

It is an object of the present invention to further develop the above described prior art.

To solve the object a groove is provided on one side of a board, and for example on an opposite side of the board at least one tongue is for example provided by means of a milling process. An adhesive or a plastic material is provided onto the groove and/or the tongue in free flowing, viscous or formable condition. The underside or the topside of a tongue are suitable. The application onto a protruding flank of the groove is for example also suitable and in particular onto an inner side of the flank.

The applied adhesive or plastic material is formed in particular in its free flowing, viscous or formable condition. The applicated and, if appropriate, already formed adhesive or plastic material is brought in a hardened or cured condition, for example by means of drying. With regard to production speed the adhesive or the plastic material is preferably chosen such that the same hardens in reaction to a chemical reaction.

In comparison to the prior art, as it is known from the EP 1 024 234 B1, the material of the locking elements can be chosen freely. The evidence introduced in the above-mentioned opposition proceedings has shown, that HDF (and thus in particularly not the softer MDF) as such, is no suitable material to counter act the gap formation on a sustained basis. Also a surface hardener, as it is described in the EP 1 024 234 B1, can not substantially change this, since such a surface hardener is only a thin overlayer, which has usually a thickness of less than 1/10 mm, and which is therefore, for example as a reaction to expansion and shrinking phenomena, sheared of in short time.

By means of the present invention it is now possible, to provide a more suitable material for particularly problematic locking elements and to produce the connection elements from conventional materials as HDF.

By applying a bar, consisting of an adhesive or a plastic material, according to the invention, these particularly problematic locking elements consist completely of a material, which can be chosen such that it is better suited to resist mechanical strains, as for example the above-mentioned shearing forces. It is in particularly different from the base material, i.e. for example of a HDF base material. Therefore, with the locking elements no fluctuations in the density are present, which are in principle always present with the materials MDF or HDF. By means of a forming step it is possible to form the locking elements such that they allow high extraction forces.

With the term extraction forces the force is meant, which is necessary to pull two connected panels apart from another. For example, for the measurement panels with a width of 40 mm are used. A given force thus refers to a panel with a width of 40 mm. However, also panels with a width of 180 mm might be used to determine the extraction force.

Compared to the prior art, as it is known from EP 1 215 352 B1, the application of a further material (i.e. apart from the material from which the board is made) is minimized, which allows a correspondingly cheap manufacturing process.

Compared to the prior art, as it is known from WO 2004/079 128 A1, the present method allows for a larger variety in the form of the locking elements. In this way it is possible, to connect two panels with each other in an essentially more durable manner.

The forming can be provided by means of for example milling off the already hardened plastic or adhesive material. Preferably the plastic or adhesive material is brought into the desired shape subsequently to the application step, i.e. when the same is not yet hardened. In this way the desired shape can be manufactured in a particularly cost effective way. In an advantageous embodiment of the invention the adhesive or the plastic material is chosen such that it is harder than the base material from which the panel is made. If for example the base material is HDF, the adhesive or the plastic material is chosen, such that it is harder as HDF in its hardened or cured condition. The adhesive or the plastic material has in this case a higher resistance against shearing forces compared to HDF-Material. As a result, a better connection between two inventive panels is achieved.

Advantageously, the plastic material or the adhesive of the locking elements is made from a material, which has, compared to HDF, a higher abrasion resistance. In this way it is achieved that the abrasion of the locking element is relevantly small, when panels connected with each other are pulled apart.

In a further preferred embodiment of the invention a steep flank is manufactured by means of a mechanical processing, which improves the positive locking connection parallel to the surface of a covering made from panels. The flank referred to is a flank which is adjacent to a corresponding surface of a locking element of a further panel, in the connected condition of two panels.

This steep flank is arranged with an angle of preferably more than 60° to the parallel plane of the floor surface, and in particularly preferred of more than 70°. Experiments have shown, that in this way values for the extraction force can be achieved, which are substantially higher compared to the prior art, as it is known from the EP 1 024 234 B1 or the WO 2004/079 128 A1.

As material for the production of the locking elements advantageously a crystallizing reactive hot meld adhesive is chosen, as it is for example used to seal off the work surfaces in kitchens at the time the present application was prepared. Such an adhesive comprises high heat resistance, good flexibility in cold conditions as well as a resistance against water vapor or solvent after its networking process is completed. Such an adhesive is usually processed at a temperature of 100° Celsius to 140° Celsius, as for example at 120° Celsius. It has usually a density of 0.9 to 1.20 g/qm$^2$, for example 1.05 g/qm$^2$. After 3 days, such an adhesive is usually completely hardened.

The adhesive or the plastic material is chosen in one preferred embodiment such that the same has a viscosity of 4.000 to 9.000 mPas, particularly preferred of 5.500 to 6.000 mPas during its processing. It has been shown, that the application as well as the subsequently following forming step in this still viscous condition is particularly successful.

In a further advantageous embodiment of the method first a recess for the reception of the plastic material or the adhesive is machined out of the board, for example by means of milling. After that the plastic material or the adhesive is suitably dosed into the recess, and in a particularly easy and reliable manner by means of a nozzle. The application of the plastic material or the adhesive onto the panel is thus achieved particularly easy, fast and reliable.

In further advantageous embodiments the groove and/or the tongue together with further coupling elements, if necessary, are only provided after application of the adhesive or the plastic material onto the board—respectively the application into the recess machined into the board—and for example by means of milling. During the removal of material from the board by means of a milling process or another mechanical machining, the plastic material or the adhesive can at least partially harden, so that the panels can be further processed subsequently to the milling without any problems. As a result, the time needed for the production process is optimized.

In a further embodiment the forming of the applied adhesive or plastic material is done in one work step with the machining of the coupling elements out of the board, for example by means of milling or by means of a draw blade. In this way, the manufacturing process is further optimized. The number of necessary tools is minimized.

Further preferred embodiments and advantages derive from the following exemplary embodiments.

DETAILED DESCRIPTION

First, wood fibers provided with glue are pressed by application of pressure and heat into a board. After that, the board is provided with a decor on the one side and further advantageously with a counter acting layer on the other side. The side with the decor is referred to as top side and the other as the bottom side. The decor layer is usually further provided with an abrasion resistant layer, which is build preferably among others by means of corundum particles or aluminum oxide particles with a medium particle size of preferably 60 to 160 μm. Further, the layer comprises usually an amino resin and in particular a melamine resin. A decor can be provided for example by means of printed paper or by means of a layer of wood.

Now, the board can be cut and/or provided on two opposing sides with conventional locking elements that allow a positive locking by means of a pivoting motion. Preferably, the locking elements are provided such that they are connected with or disconnected from each other exclusively by means of for example a pivoting motion, but not by means of a displacement in one plane. A displacement in one plane includes the risk that the panels, which are connected to each other by means of a form fitting, undesirably disconnect again after installation. This is not the case with locking elements which allow a locking only by means of a pivoting motion. Such locking elements are preferably provided at the longitudinal sides of the panels.

Figure 1:
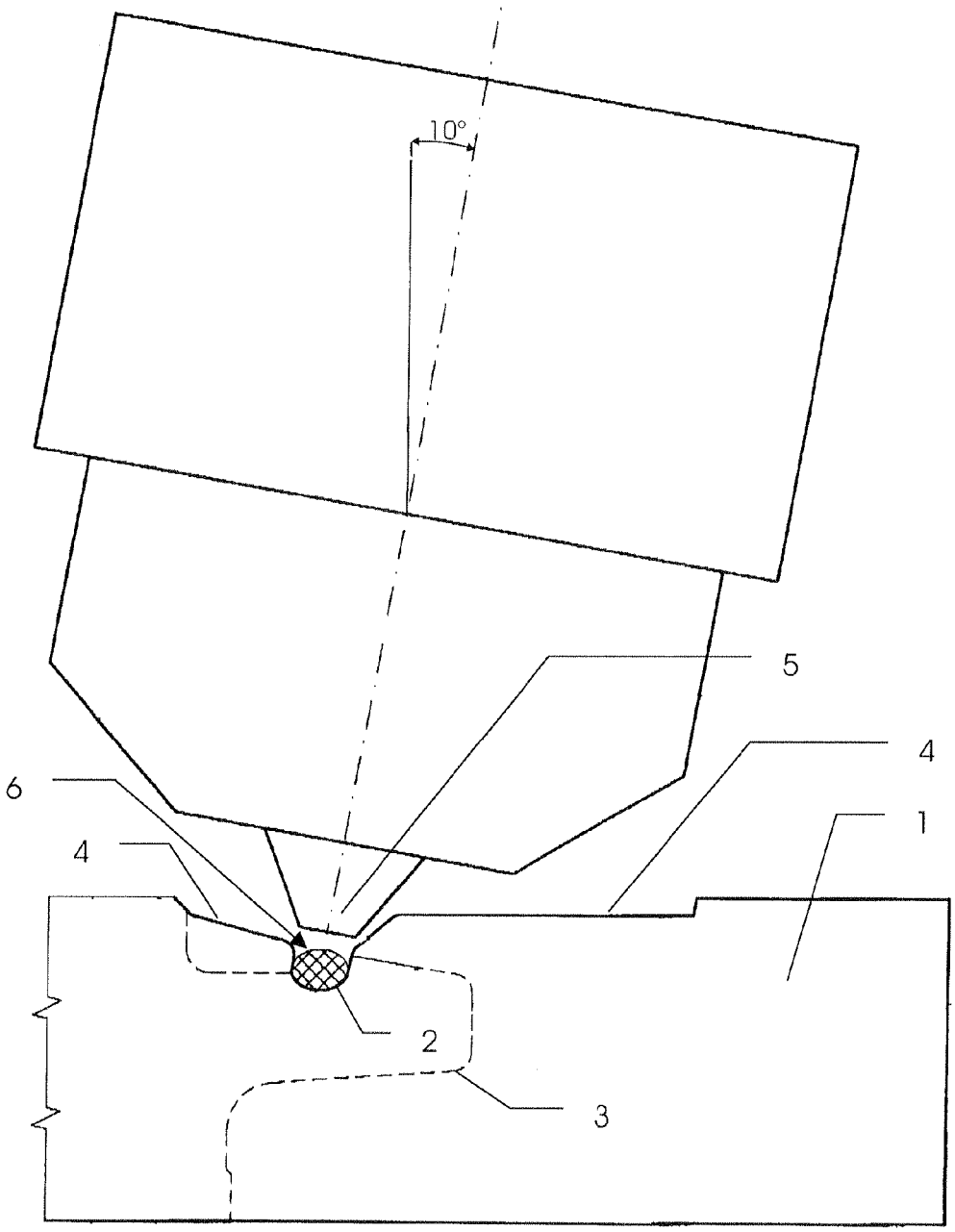
FIG. 1 shows a board with a recess milled therein.
Figure 2:
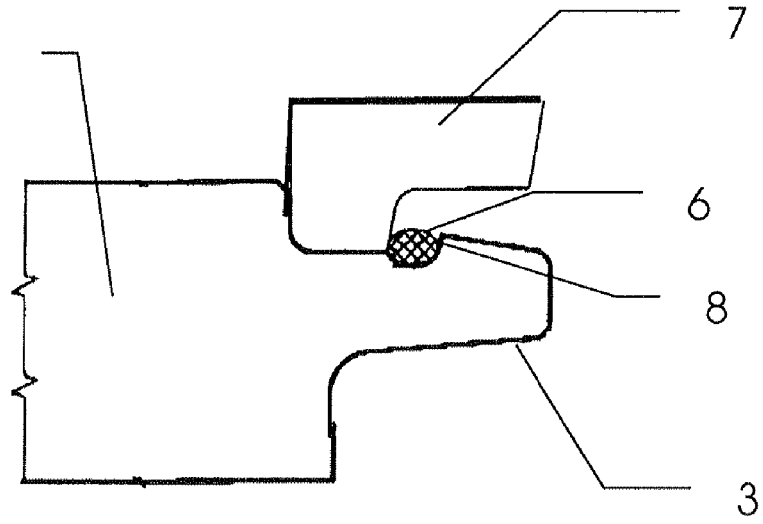
FIG. 2 shows the board with a tongue.

In a further step a groove-like recess is milled out of the bottom side of the board 1 and, if necessary, from a not yet processed side of the board. FIG. 1 shows such a board 1 with a recess 2 milled therein. The position of the recess 2 is chosen that the same reaches at least partially into the tongue 3, which is milled later on, and which is shown in FIG. 1 with dashed lines. In addition to the groove-like recess 2, in an advantageous embodiment further material is milled out of the board, to provide a further space 4 for the nozzle, which in this way can particularly easily be arranged next to the recess 2. The additional room respectively space 4 is provided by removing material from the board, which is not needed for the manufacturing of the final panel.

In the next step an adhesive, namely a quick crystallizing reactive hot meld adhesive is applied in form of a string or bar, in the following referred to as adhesive bar 6, into the groove 2 by means of a nozzle 5 in a suitable manner. A suitable adhesive is commercially available under the name Jovatherm Reaktant™ 600.70, 600.72 from the company Jovat A G, Detmold, D-32709. This adhesive was used.

By means of the above-explained method it is possible to connect the adhesive bar 6 in a desired and particularly reliable manner with the bottom side of the later to be formed tongue 4.

Directly subsequent to the application of the adhesive bar 6 the tongue 3 is completely milled out of the board 1. At the same time with the milling, a suitably chosen milling tool 7 is not only used to remove in a suitable manner material from the board to provide the tongue 3, but also to provide the adhesive bar 6 on one side with a desired shape and in particular with a steep flank. In this way, the manufacturing is particularly cost effective. The flank is arranged at an angle of more than 60° and less than 90° with respect to the plane of the bottom side of the board, to achieve high extraction force values. Particularly preferred, the angle is more than 70°.

Preferably, the tongue 3 is milled out of the board 1 such that the adhesive bar is held by means of a sufficiently high lateral boundary 8 at the free end of the tongue. The lateral boundary 8 is preferably higher as the opposing lateral boundary of the groove respectively the recess 2, to provide for a particularly good hold. Preferably, the lateral boundary 8 is at least 0.3 mm higher compared to the other boundary. In this way, the hold of the adhesive bar 6 is thus not provided alone by the force fitting connection between the adhesive and the base material of the panel.

Figure 3:
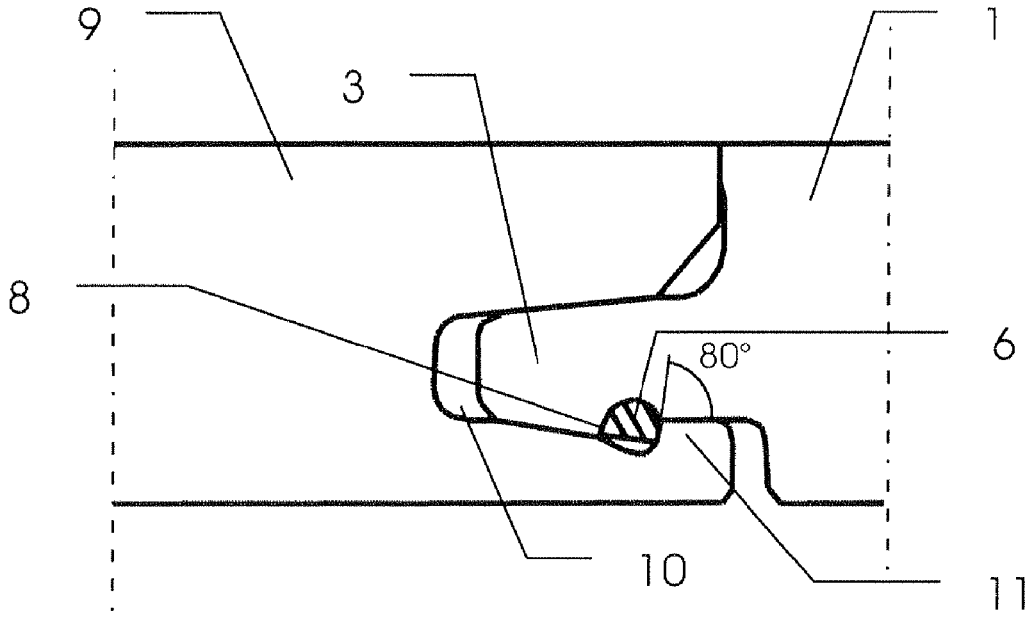
FIG. 3 shows the board with a completed tongue.

FIG. 3 shows the completed tongue, as it is milled out of the board 1 with the adhesive bar arranged underneath the tongue. The thickness of the board made of HDF is 6.8 mm. Further, FIG. 3 is a true to scale drawing of the manufactured coupling respectively connecting elements of two panels connected to each other. Panel 9 comprises a groove 10 having a locking element 11, which projects upwardly from the lower flank of the groove by means of 0.54 mm. Connecting elements 10 and 11 are milled out of a 6.8 mm thick HDF board in one piece.

The connecting element 11 comprises a surface, which is adjacent to the adhesive bar in coupled condition. The adjacent surfaces are arranged at an angle of 80° with respect to the bottom side of the boards. The common surface in the direction shown is 0.4 mm.

The upper flank of the groove 10 is provided thicker as the lower flank. In this way it is secured, that the upper flank is not deflected during the connection or during any other events. By this, the visible surface of a covering made from this panels is always plane.

The flanks of the groove 10 are preferably of essentially the same length. A tongue can pass into the groove in a particular reliable manner, when the panels are connected with each other by a displacement in one plane.

A particular notable feature of the adhesive bar 6 shown in FIG. 3 is that all faces accessible from the outside are smoothed. This results from the fact, that after the application of the adhesive the forming of the same is done at the same time with the final milling of the groove. During the milling of the groove at the same time also the faces of the adhesive material facing outwardly are smoothened. Thus, it is no longer provided with the typical curvatures which are present when an adhesive material is applied in its free flowing condition in form of a bar or string, in which condition its surface tends to take-up the shape of a circle.

Figure 4:
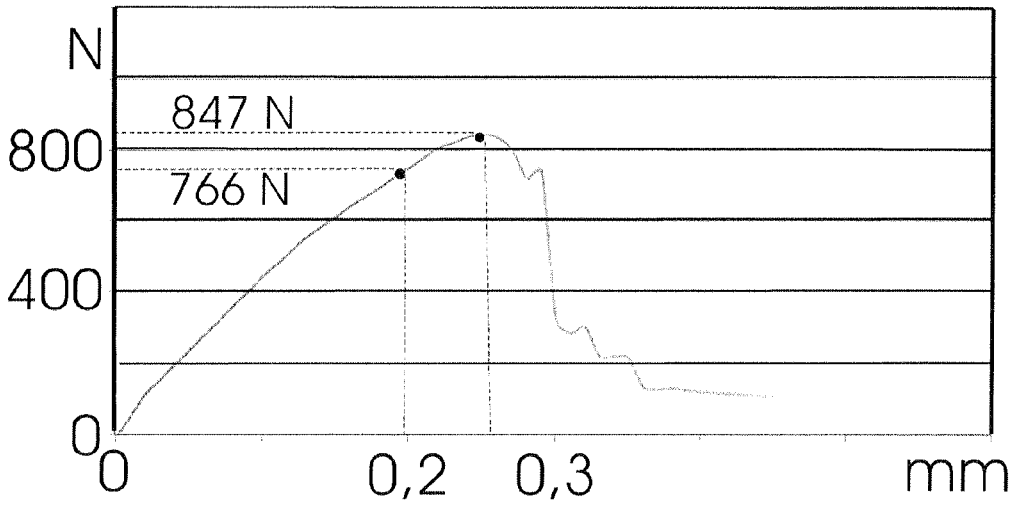
FIG. 4 shows the development of the extraction force for the panels shown in FIG. 3 measured in Newton against the gap opening measured in millimeter.

FIG. 4 shows the development of the extraction force for the panels shown in FIG. 3 measured in Newton [N] against the gap opening measured in millimeter [mm]. The pulling test was conducted according to ISO TC 24334. In order to separate two panels from each other a force of 847 N was necessary. This is a value, which was not achievable in the case of a groove with two flanks of the same length having apart from that the same geometry and the same dimensions but no adhesive bar 6. This was shown by the evidence presented in the opposition procedures against the patent EP 1 024 234 B1. A gap opening of 0.2 mm occurred with the panels shown in FIG. 3 at a force of 766 N.

The panels shown in FIG. 3 can be connected by means of a displacement in one plane. This means a displacement perpendicular to the common gap. In principle, such panels could also be separated again from each other by a displacement in one plane. The latter is usually not desired in a covering, since the panels should be securely fastened to each other.

Figure 5:
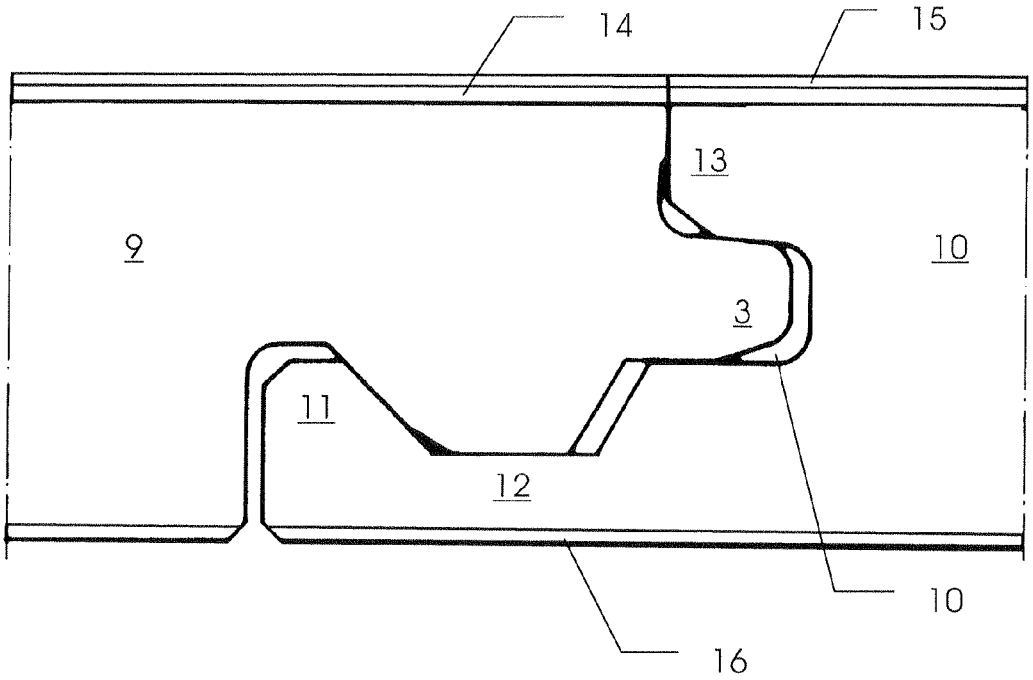
FIG. 5 shows connecting elements of two panels.

FIG. 5 shows connecting elements of panels 9 and 10, which can not to be connected with each other by means of a displacement in one plane without any glue, since the flanks 12 and 13 of the groove 10 can not be deflected elastically apart from each other to a sufficiently extend. To enable a connection of the panels, the geometry is chosen such that a connection by means of a pivoting motion is possible. Such panels can in principle not be separated from each other by means of a displacement in one plane (i.e. the pulling apart in a plane perpendicular to the common gap) in the installed condition of the panels. This is an advantage with the installed panels, since it secures the connection of the panels.

The installation is however difficult if only connection respectively coupling elements according to FIG. 5 are provided on a panel. Therefore, panels are preferred, which have at two opposing sides coupling elements, which do not allow a connection by means of a displacement and which are provided on the remaining two sides with coupling elements that do allow a connection by means of a displacement. In this case, first the panels are connected with each other at those sides, which do not allow a displacement. After that the further sides are connected with each other by means of a displacement. An adhesive bar is only particularly advantageous with coupling elements that allow a connection by means of a displacement. All other connections not using glue lock for the above given reasons anyway parallel to the surface of the covering in a particularly reliable manner. In the later case, the provision of an adhesive bar according to the invention is therefore less important.

For cost reasons, preferably coupling elements respectively connection elements are only provided with an adhesive bar, if a connection by means of a displacement in one plane is possible. Usually, the narrow edges of the panels are provided with such coupling elements, which allow a connection by means of a displacement. For the above given reasons the longitudinal sides of the panels are advantageously provided with coupling elements, which do not allow a connection by means of a displacement in one plane, but which are connected for example by means of a pivoting motion or by means of a lowering motion. For cost reasons, no adhesive bar in the sense of the invention is provided on the longitudinal sides.

In FIG. 5 it is further shown, that a board is provided with a décor layer 14 as for example a décor paper, as well as with a transparent covering layer 15 provided above the décor layer, for example comprising a melamine resin with corundum powder. Underneath the board a layer 16, for example consisting of paper, is arranged, which acts as a counter acting means, to prevent a distortion of the board. The covering layer protects the décor against mechanical and/or chemical influences.

The invention claimed is:

1. A method for the production of a panel for floors, walls or ceilings, comprising:

providing a panel having connection elements made from a wood-based material, the connection elements comprising a groove and a tongue, which are machined out of longitudinal sides of the panel, whereby the tongue is not completely machined out of the panel;

providing a further locking element being connected thereto by means of a force fitting, which consists of a plastic material or an adhesive which is a reactive hot melt adhesive by applying the plastic material or adhesive in the form of a bar to a surface of the tongue; and then in one work step, forming the plastic material or adhesive with a tool while at the same time machining the tongue completely out of the panel with the tool.

2. A method according to claim 1, wherein the connection element is machined by means of a milling process.

3. A method according to claim 1, wherein the adhesive or the plastic material is formed in still free flowing condition.

4. A method according to claim 1, wherein the further locking element comprises a surface facing the panel, which is planar and arranged at an angle of 60-90° relative to the bottom side of the panel.

5. A method according to claim 1, wherein the plastic material or the adhesive consists of a curable material compared to the material from which the groove or the tongue is made.

6. A method according to claim 1, wherein the plastic material or the adhesive run parallel to one side of the panel.

7. A method according to claim 6, wherein the plastic material or the adhesive have a diameter of 0.3 mm-0.6 mm.

8. A method according to claim 1, wherein the board comprises a wood-based material.

9. A method according to claim 1, wherein the board is a particle board, HDF, MDF, plywood, solid wood, or formed from papers which are pressed together.

10. A method according to claim 1, which are formed so that a connection is possible by means of a displacement in one plane.

11. A method according to claim 1, wherein the panel is provided with connection means on two opposing sides with which a connection by means of a displacement in one plane is not possible.

12. A method according to claim 1, wherein the plastic material or the adhesive is arranged in a recess.

13. A method according to claim 1, wherein the plastic material or the adhesive is held by means of a projecting wall by means of a positive fitting.

14. A method according to claim 1, wherein the plastic material or the adhesive is held by means of a projecting wall by means of a force fitting.

15. A method according to claim 1, wherein the plastic material or the adhesive is arranged underneath a tongue.

16. A method according to claim 1, wherein the panel is provided with a groove having equally long groove flanks on a narrow edge thereof.

* * * * *

UNITED STATES PATENT AND TRADEMARK OFFICE

CERTIFICATE OF CORRECTION

PATENT NO. : 8,394,451 B2
APPLICATION NO. : 11/814287
DATED : March 12, 2013
INVENTOR(S) : Maik Moebus It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1418 days.

Signed and Sealed this
First Day of September, 2015

Michelle K. Lee

Michelle K. Lee
*Director of the United States Patent and Trademark Office*